US007617804B2

(12) United States Patent
Cordy, Jr.

(10) Patent No.: US 7,617,804 B2
(45) Date of Patent: Nov. 17, 2009

(54) AXIAL FLOW COOLING FOR AIR-COOLED ENGINES

(76) Inventor: Clifford B. Cordy, Jr., c/o Charles Cordy, 1838 SE. Burley Olalla Rd., Port Orchard, WA (US) 98367

( * ) Notice: Subject to any disclaimer, the term of this patent is extended or adjusted under 35 U.S.C. 154(b) by 38 days.

(21) Appl. No.: 11/860,300

(22) Filed: Sep. 24, 2007

(65) Prior Publication Data

US 2008/0029048 A1 Feb. 7, 2008

Related U.S. Application Data

(63) Continuation-in-part of application No. 10/950,371, filed on Sep. 27, 2004, now abandoned.

(60) Provisional application No. 60/505,683, filed on Sep. 25, 2003.

(51) Int. Cl.
*F02F 1/06* (2006.01)

(52) U.S. Cl. ..... 123/41.69

(58) Field of Classification Search ..... 123/41.69
See application file for complete search history.

(56) References Cited

U.S. PATENT DOCUMENTS

| | | | | | |
|---|---|---|---|---|---|
| 790,374 | A * | 5/1905 | Maxwell | ..... | 123/56.4 |
| 1,012,635 | A | 12/1911 | Harmer | | |
| 1,363,708 | A * | 12/1920 | Bennis | ..... | 123/41.39 |
| 1,511,201 | A * | 10/1924 | Kettering | ..... | 123/41.69 |
| 1,838,974 | A | 12/1931 | Williams | | |
| 2,098,741 | A * | 11/1937 | Christian | ..... | 123/41.69 |
| 4,047,508 | A | 9/1977 | Schramm | | |
| 4,633,823 | A | 1/1987 | Haas et al. | | |
| 5,421,292 | A | 6/1995 | Hoffman et al. | | |
| 6,877,315 | B2 | 4/2005 | Clark et al. | | |
| 2005/0066916 | A1 * | 3/2005 | Cordy, Jr. | ..... | 123/41.69 |
| 2007/0034173 | A1 * | 2/2007 | Lee | ..... | 123/41.69 |

OTHER PUBLICATIONS

Angle, Glenn D., Aerosphere • 1939, Aircraft Publications, New York, NY, 1940, p. 39.

* cited by examiner

*Primary Examiner*—Hai H Huynh
(74) *Attorney, Agent, or Firm*—Seed IP Law Group PLLC

(57) ABSTRACT

A head for an air-cooled engine having at least two cylinders, each cylinder having a longitudinal axis, the head having a rocker arm mounted to rotate about a rocker arm axis in the head, the head further including an intake port and an exhaust port, and the head mounted on a first cylinder of the two cylinders to define a combustion chamber, the head having at least two fins, each fin having a height-to-thickness ratio of greater than or equal to 5, each fin having a length that is at least 5 times the distance between the at least two fins at a location on the head that is between the first cylinder and the rocker arm axis on the head, and each fin positioned on the head with the fin length oriented along an axis that is substantially parallel to the longitudinal axis of the first cylinder.

20 Claims, 11 Drawing Sheets

AXIAL FLOW COOLING FOR AIR-COOLED ENGINES

BACKGROUND OF THE INVENTION

1. Field of the Invention

The present disclosure pertains to the cooling of internal combustion engines and, more particularly, to a unique fin design for use with air-cooled engines, such as aircraft engines, automobile, truck, and motorcycle engines, and stationary, fan-cooled engines.

2. Description of the Related Art

In general, air-cooled engines have fins that require the cooling air to flow in a direction perpendicular to the axis of the cylinder. In a single cylinder engine, or an engine with a single bank of cylinders (such as a V2, a horizontally opposed 2, or a single bank radial), this is not a bad configuration. There is adequate space for fins and cooling air. Even a double bank radial works fairly well because the cylinders of the rear bank are oriented between the cylinders in the front bank, so there is adequate access for the cooling air to reach the aft cylinders. In the horizontally opposed air-cooled engines with 4 or more cylinders that are commonly used in automotive and aircraft applications, having the fins oriented perpendicular to the longitudinal axis of the cylinders is a serious disadvantage. The air flow must be oriented parallel to the fins. That means either (1) the air flow thru the fins must be parallel to the axis of the crankshaft, which provides less cooling for cylinders behind the front cylinder, or (2) it must be perpendicular to both the crank axis and the cylinder axis, which is the orientation used in all modern applications.

It takes power to drive cooling air thru the fin structure. Ultimately, in any mobile application, this power must come from the engine being cooled. This reduces the useful power output of the engine, and the net efficiency of the engine. There has been substantial effort for more than a century in designing efficient fin configurations for cooling engines with a minimum of lost power. To achieve efficient cooling, it is desirable to have the cross section of any given gap between fins to remain a constant area as the air passes thru the engine. With this configuration, the air moves with a constant velocity, and a minimum of power is required to provide a given amount of cooling. In addition, the path length thru the engine should be minimized to maintain a thin boundary layer between the fin and the moving air.

Now consider the situation in standard down-draft (or updraft) cooling where essentially all the air must pass between the cylinders. The air enters above the cylinder and head, which are typically 10 to 20 cm wide. Then it passes thru the gap between the cylinders, typically 1 to 2 cm wide. Then it is blown out beneath the cylinders and heads, again 10 to 20 cm wide. With careful duct design, the cooling air can be guided around the engine to pass over most of the fins. But the restriction at the passage between cylinders always increases the pressure required to force sufficient air thru the engine, and there are unavoidable dead-air regions above and below the cylinder and combustion chamber where very little cooling occurs. The power required is the product of pressure times volume flow rate. The volume flow rate is fixed by the cooling requirements of the engine. If there is a restriction in the flow path that has half the area of the rest of the path, the flow velocity at that point will be twice as high as the velocity over the rest of the fin. Since pressure drop increases approximately with the square of flow velocity, the pressure drop per unit distance of air travel in the restriction will be four times as high as in the rest of the engine. With the air flow passing down between the cylinders, this is unavoidable. The result is excessive power required for cooling (very undesirable), and the possibility of insufficient cooling under some or all operating conditions (even more undesirable).

It does little good to try to cool the engine from the "top" (farther from the crank shaft). The rocker arms sit on top of the engine, and that assembly introduces so much thermal impedance that it is impractical to cool the heads by using fins over the rocker arms. Porsche has developed a head in which the two valves are one above the other, as opposed to side by side, giving more space for fins and air passages between the heads. This requires a tricky valve linkage and does nothing for the flow restriction between cylinders and the base of the heads.

For a specific example of present cooling problems, consider the Jabiru engine, built in Australia. The Jabiru has several desirable characteristics. It is a very compact engine for its power rating. Largely as a result of this, it is considerably lighter than other engines of similar power. Also, the small size makes the structure strong. Size and weight are important in many applications, and critical in aircraft. Strength is always desirable. A 6 cylinder Jabiru rated at 130 horsepower (100 kW) is essentially the same size as, and lighter than, a 4 cylinder Volkswagen producing half the power. There is no free lunch. The cost of the reduced size and weight of the Jabiru engine is that the compact design makes it essentially impossible to cool the engine when operated at rated power. Thru the remainder of this disclosure, the Jabiru engine will serve as the model. However, all the results from this analysis of the Jabiru engine are obviously applicable to other engines, including in-line and horizontally-opposed air-cooled engines.

FIG. 1 is a schematic representation of two adjacent cylinders 20, 22 of an engine, looking down an internal axial bore 24, 26 of each of the cylinders 20, 22. Each cylinder 20, 22 has a protrusion 27, 29 that inserts into a mating recess in the bottoms of the heads (not shown in this view). A plurality of fins 32, 34 surround the cylinders 20, 22. In addition, an engine needs head bolts (not shown), which are received in bolt holes 36. For strength, the head and cylinder both require a reasonable amount of material 38 surrounding the bolt holes 36. In the case of the Jabiru engine, there are six head bolts holding each head and cylinder together. This gives a great improvement in strength and rigidity over VW and Porsche engines which use only 4 head bolts. In many aircraft engines, the top of the cylinder is threaded and the entire head screws on. This gives even better mechanical stability than the Jabiru engine, but the added space required for the threads further restricts air flow between the edges of the heads.

Now consider the situation faced by the cooling air. The air typically enters at the top of the engine and flows down over the fins of the head and cylinder (downdraft cooling). The situation does not change much if the direction of flow is up from below the engine (updraft cooling). The air enters the fin structure in a region where the fins are typically 30 mm high and is squeezed between the cylinders where, in the case of the Jabiru engine, the fins are only 5 mm high. Thus, the air must travel 6 times as fast while it is between the cylinders, which requires 36 times as much pressure drop per unit distance traveled, and 36 times the power per unit distance of flow. Ultimately, this power comes from the engine, and this consumption of power decreases the power available to do useful work.

The problem is intensified in the Jabiru engine, where the use of six head bolts means that there is a long path length where the air must travel at high velocity. Also, when forcing air to flow around a cylindrical obstacle, the air flow tends to leave a dead air zone ahead of the center of the cylinder, and a much bigger dead air zone behind the center of the cylinder (ahead and behind from the perspective of the flowing air). Careful use of ducts to guide the air will reduce the sizes of these dead air regions, but it cannot eliminate them entirely. Another problem is that the conductivity of heat from the metal fin to the air increases with increasing air velocity. Where the air moves slowly, a thick boundary layer forms, and conductivity into the air is low. In the situation shown in FIG. 1, the air travels slowly over 90% of the fin area, giving poor cooling, and where the air travels rapidly; there is not enough fin area to give adequate cooling.

Now consider the path length of the flow thru typical fins. In round numbers, this path length will be $\pi$ times the average radius of the cylinder fins. If the cylinder has a bore of 100 mm, that is a radius of 50 mm. The cylinder wall has a thickness of about 5 mm, and the head must surround that by about an additional 5 mm. Thus, the radius from the longitudinal axis of the cylinder to the base of the fins will be about 60 mm. If the fins are 30 mm high, the average radius of the fins becomes 75 mm. That gives a flow path length of 235 mm. This is a much longer path length than is desirable from purely thermodynamic considerations. Typical automotive radiators have path lengths of under 50 mm, and they usually have staggered fins within that distance. Aircraft oil coolers typically have air path lengths of 15 to 20 mm, with staggered fins within that distance. A flow path length of 235 mm is asking for thick boundary layers and unacceptable conductivity from the fin to the air.

BRIEF SUMMARY OF THE DISCLOSURE

In accordance with one aspect of the present disclosure, a head for an air-cooled engine having at least two cylinders is provided, each cylinder having a longitudinal axis, the head having a rocker arm mounted to rotate about a rocker arm axis in the head, the head further including an intake port and an exhaust port, and the head mounted on a first cylinder of the two cylinders to define a combustion chamber, the head including at least two fins, each fin having a height-to-thickness ratio of greater than or equal to 5, each fin having a length that is at least 5 times the distance between the at least two fins at a location on the head that is between the first cylinder and the rocker arm axis on the head, and each fin positioned on the head with the fin length oriented along an axis that is substantially parallel to the longitudinal axis of the first cylinder.

In accordance with another aspect of the present disclosure, the foregoing head is structured to have more total fin surface area provided near the exhaust port than near the intake port in the head. In accordance with another aspect of the present invention, the head occupies more space an the exhaust side of the cylinder longitudinal axis than on an intake side of the cylinder longitudinal axis to provide additional space for additional cooling fins that are positioned in an area adjacent the exhaust port.

In accordance with another aspect of the present disclosure, fins on the head are positioned over at least a portion of the combustion chamber.

In one embodiment, the thickness of each fin is constant from 10% of the fin height to 90% of the fin height.

In accordance with another aspect of the present disclosure, each fin has a thickness that is greater than the average thickness at 10% of the fin height and a thickness that is less than the average thickness at 90% of the fin height.

In accordance with still yet a further aspect of the present disclosure, each fin has a free end that has a shape that is more aerodynamic than a fin end that is square. "More aerodynamic" in this case means aerodynamically efficient and producing or having less drag than a fin with a square end.

In accordance with another aspect of the present disclosure, a cylinder for an air-cooled engine having at least two cylinders is provided, the cylinder having a longitudinal axis and at least one pair of fins, each fin having a height-to-thickness ratio of at least 5 for a length of at least 0.1 times a length of the cylinder, the pair of fins oriented substantially parallel to the longitudinal axis of the cylinder.

In accordance with a further aspect of the present disclosure, an airplane is provided that includes an air-cooled engine having at least two cylinders and a head associated with each cylinder, each cylinder having a longitudinal axis, the head having a rocker arm mounted to rotate about a rocker arm axis in the head, the head further including an intake port and an exhaust port, and the head mounted on a first cylinder of the two cylinders to define a combustion chamber, the head having at least two fins, each fin having a height-to-thickness ratio of greater than or equal to 5, each fin having a length that is at least 5 times the distance between the at least two fins at a location on the head that is between the first cylinder and the rocker arm axis on the head, and each fin positioned on the head with the fin length oriented along an axis that is substantially parallel to the longitudinal axis of the first cylinder.

DETAILED DESCRIPTION OF THE INVENTION

Figure 1:
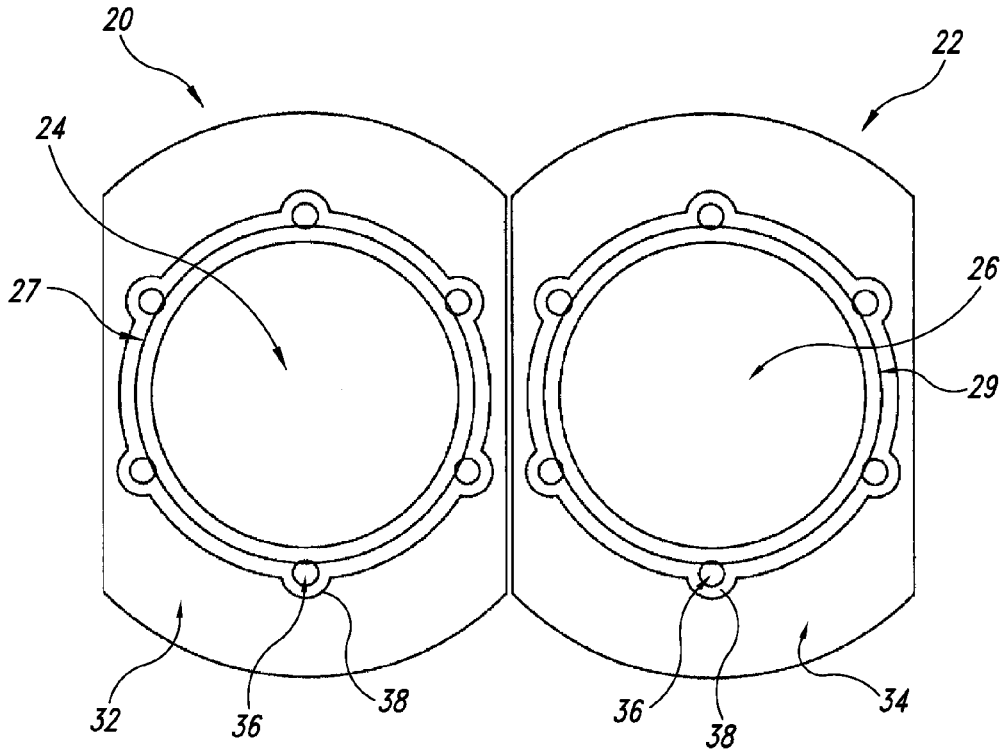
FIG. 1 (Prior Art)
FIG. 1 is a view of an engine using conventional downdraft cooling, looking down the axis of piston travel.

Most of the problems of both updraft cooling and downdraft cooling are eliminated by a novel cooling configuration disclosed herein, henceforth referred to as axial cooling, with the flow of cooling air traveling substantially parallel to the axis of the cylinder. Fins on the cylinder and head are oriented so they are substantially parallel to the axis of the cylinder. Cooling air is injected into the fin structure near the rocker arms. From there it flows over the head fins, then over the cylinder fins toward the crankcase. Ducts contain the air within the fin structures. The ducts may terminate some distance from the crankcase, allowing the warmed air to escape. Better, the ducts may guide the warmed air toward the cooling air outlet, where it may be accelerated out of the engine compartment using exhaust augmentation. It is not necessary for the fins on the head to be aligned with the fins on the cylinder. In fact, it is undesirable for the two sets of fins to be aligned. Having a discontinuity in the fins between the head and cylinder disrupts the boundary layer, yielding improved heat transfer from the cylinder fins to the air.

It is possible to pump the air in the opposite direction, i.e., from near the crankcase to the rocker arms. But, thermodynamically it is better to pass the coldest air over the region with the highest heat loading, i.e., the exhaust ports, near the rocker arms. Also, more heat can be extracted from the fins near the air input, where the boundary layer is thin. So it is desirable to inject the cooling air where the heat load is greatest, near the exhaust port. In addition, the ducts are easier to make and install if the air flow is from the rocker arms toward the crankcase.

While the above description is perfectly clear to anyone skilled or unskilled in the art, it is not mathematically definitive. The following is a mathematical definition of axial flow and axial fins using a mechanical model. Consider a small rod with a diameter of ½ the spacing between adjacent fins and a length 5 times the spacing between adjacent fins. If this rod can be held parallel to the cylinder axis and located in its entirety in the space between any pair of adjacent fins and below the tops of these adjacent fins, at any location along the length of these adjacent fins, then the fins are substantially parallel to the axis of the cylinder. This definition holds for fins located anywhere on the body of the cylinder, and for fins located anywhere on the body of the head between the cylinder and the axis of the rocker arms. This axial flow test can be applied to the head and cylinder fins independently. For purposes of defining axial flow, this test applies only to locations between the crankcase and the axis of rotation of the rocker arms.

A similar definition is made for transverse flow. A small disk is provided with a diameter of 5 times the fin spacing and a thickness of ½ the fin spacing. When this disk is positioned perpendicular to the axis of the cylinder and inserted into the space between fins to a depth that EITHER the entire disk is below the tops of the fins OR the bottom of the disk reaches ¾ of the depth of the space between fins at any place along the length of the fins, then the fins and air flow are functionally transverse. For purposes of defining transverse flow, this test applies only to locations between the crankcase and the axis of rotation of the rocker arms.

For these tests to make sense, the length of the fins (measured in the direction of air flow) must exceed 5 times the fin spacing. In any real world situation, the fin length will be much greater than that. As a physical reality, any orientations other than axial and transverse are either impossible or so cumbersome as to be impractical.

In some engines, there are small fins across the top of the head (the part of the head furthest from the crankcase). These fins are normally either horizontal or vertical. In neither case do they fit into the concept of axial or transverse, although they may pass the test defined above for axial fins. Clearly, these are not axial fins. Thus the above test is limited to those fins located between the crankcase and the axis of rotation of the rocker arms.

Fundamentals of Air Cooling

Heat is a form of energy. In order to cool a hot body, the energy has to be transferred to another material, most commonly air or water. The rate at which energy is transferred (energy per unit time) is power. If the hot object is being heated continuously, it has to be cooled continuously at the same rate, or the object will change temperature. In the case of air cooling, there is a high thermal resistance at the surface where air is in contact with the hot body. That means it is difficult for the heat energy to transfer from the hot body to the surrounding air. To increase heat flow, it is common that the air is moved across the surface of the hot body, often with a fan. This is called forced air cooling. If the thermal power density (power per unit volume or power per unit surface area) delivered to the hot body is significant (as in an engine, or many types of electronic gear) then it is insufficient to blow air across the hot body. The hot body will overheat and will fail in some manner. In any given situation, there is a given thermal power that needs to be removed from the hot body, and some maximum temperature that can be tolerated. Blowing air over the hot body faster helps some, but there are very real practical limits to this. The only way to substantially increase heat flow into the passing air is to increase the surface area of the hot body. This is done by putting fins on the hot body, or attaching the hot body tightly to a finned structure.

If the thermal power is only slightly more than the power that can be dissipated from the hot body without fins, then only small fins are required. But, in the case of working engines and high power electronics (notably computer CPUs), large fins are required. Any given fin has three dimensions—height, thickness, and length. Height is the dimension above the hot body, and length is the dimension in the direction of air flow, in most cases, forced air flow. There are two common fin shapes, rectangular and tapered. Rectangular fins are the same thickness from near the bottom of the fin to near the top of the fin. Tapered fins typically have a trapezoidal cross section and are significantly thicker near the bottom of the fin than they are near the top of the fin. If the air flow over the fin is the same everywhere, tapered fins are more efficient, but they are harder to make, and air tends to stagnate in the restricted space near the bottoms of the fins, which can more than offset the advantage of better efficiency. In either case, the thickness of the fin is usually measured at half the height of the fin.

Similarly, fin spacing is the distance between fins measured at half the height of the fin. In the real world, fins designed for thermal dissipation (hereafter referred to simply as fins) rarely have a height-to-thickness ratio (H/T ratio) under 10. Surface irregularities serving other functions rarely have an H/T ratio exceeding 2. This makes a distinction between cooling fins and other structures. In some cases, physical constraints imposed by other considerations prevent cooling fins from having H/T ratios of 10, or even 5. There are many cases when a designer has to live with this, but it is not optimum from the point of view of power dissipation.

The physical details behind fin design are very complex. The resulting design formulas that are actually used are algebra (no calculus), but they are not simple. H, T, L, H/T, spacing, air velocity, ambient air temperature, temperature of the hot body, and the temperature difference between the hot body and the ambient air temperatures all affect thermal power dissipation. The mathematical details are beyond the scope of this discussion. The optimum H/T ratio depends on the definition of optimum in any given application, and often that is not easy to define, much less calculate. In general, more heat can be dissipated from a part by using fins with a greater H/T ratio, but there are both theoretical and practical limits to this. As the H/T ratio gets larger, a quantity called fin efficiency goes down, so the law of diminishing returns takes control. Also, tall, thin fins are difficult to manufacture, and they are fragile in real world environments. The practical upper limits for the H/T ratio are usually 20-25, although there always are exceptions.

The length of the fin has an effect on the thermal power that can be removed from the fin. When a stream of air first encounters a fin oriented parallel to the direction of air flow, the air moves quickly over the surface of the fin. As the air moves along the fin, friction between the fin and the air stream causes the air close to the fin to slow. This layer of slow moving air is called the boundary layer. The boundary layer becomes thicker with increasing distance along the fin. This relatively stagnant air heats quickly and forms a barrier to heat flow into the bulk of the moving air. Thus, it is desirable to keep the lengths of fins small. There is more discussion of the effects of boundary layers as applied to engine design hereinbelow.

Turning next to the figures, for purposes of illustration, the figures show axial cooling adapted to the Jabiru engine. Similar adaptations can be made to other air-cooled engines. The compact design of the Jabiru engine provides a severe test for any cooling scheme. If it will work with the Jabiru engine, it will work with any engine.

Figure 2:
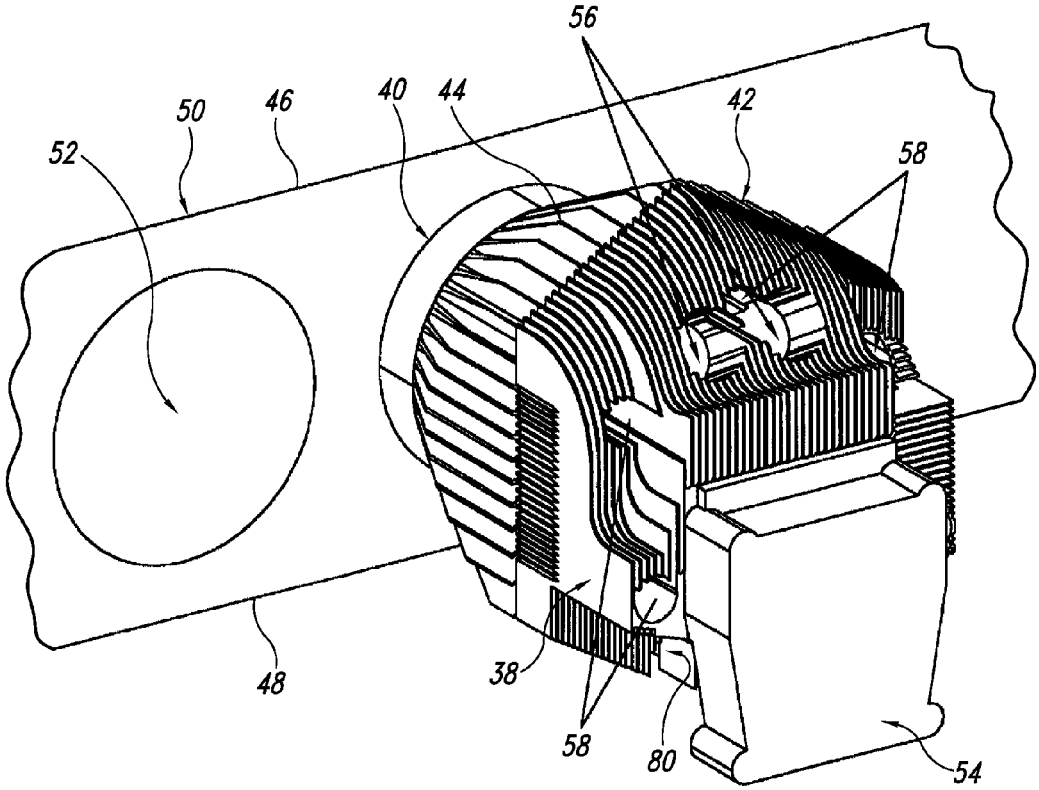
FIG. 2 is a trimetric view a cylinder and head assembled to the side of a crankcase showing a general view of the fins and air paths in accordance with the present disclosure.

FIG. 2 is a dimensionally correct view of a Jabiru head 38 and cylinder 40 bolted together, both with fins, i.e., head fins 42 and cylinder fins 44, for axial flow cooling. Shown in FIG. 2 are the top and bottom edges 46, 48 of a crankcase 50 and an adjacent hole 52 for mounting a neighboring head and cylinder (not shown). The cylinder 40 is mounted to the crankcase 50 and is covered with the cylinder fins 44 for axial flow cooling. The head 38 is mounted to the cylinder 40 and is covered with the head fins 42 for axial flow cooling. The major features of the head 38 include a rocker arm housing 54, cutouts 56 in the head fins 42 for installing spark plugs (not shown), additional cutouts 58 in the head fins 42 for installing head bolts (not visible in this view), and more cutouts 80 in the head fins 42 that allow clearance for the push rod tubes (not shown). Intake and exhaust ports (not visible) are under the head 38.

In operation, most if not all of the foregoing structure is not visible because the entire set of heads and cylinders is covered by a duct (not shown) that constrains the cooling air to flow from beyond the rocker arm housing 54, thru the head fins 42 and cylinder fins 44, and toward the crankcase 50. Note that approximately half the air enters the fin assembly above the longitudinal axis of the cylinder 40; the other half enters below that axis. Thus, no more than half the total cooling air has to pass between adjacent cylinders. Also note that the cylinder fins 44 are tall near the head 38, where the heat load is great, and taper to zero toward the crankcase 50, where there is little heat load. Near the crankcase 50, the cylinder walls can be much thinner than they are near the head 38 because there is little combustion pressure at the bottom of the piston stroke. Jabiru presently makes their cylinders this way. Between the heads 38 there is a minimum space of about 11 mm where the heat load is greatest and there is 26 mm between the bottoms of the cylinders 40, where there is little heat load. With downdraft cooling, it is necessary to cram all the useful air for head cooling thru an 11 mm by 70 mm space that is half full of fins. This gives less than 400 square mm of space that is high resistance because of the existence of the fins.

With axial cooling, there is approaching 800 square mm of space between cylinders, carrying no more than half as much air from above the engine to below it, with no fins to impede the flow. In addition, a real engine is not an infinite array of cylinders. The ducts can be shaped such that a significant fraction of the air that cools the top of the engine is guided around the ends of the engine, further reducing the flow required between cylinders.

Figure 3:
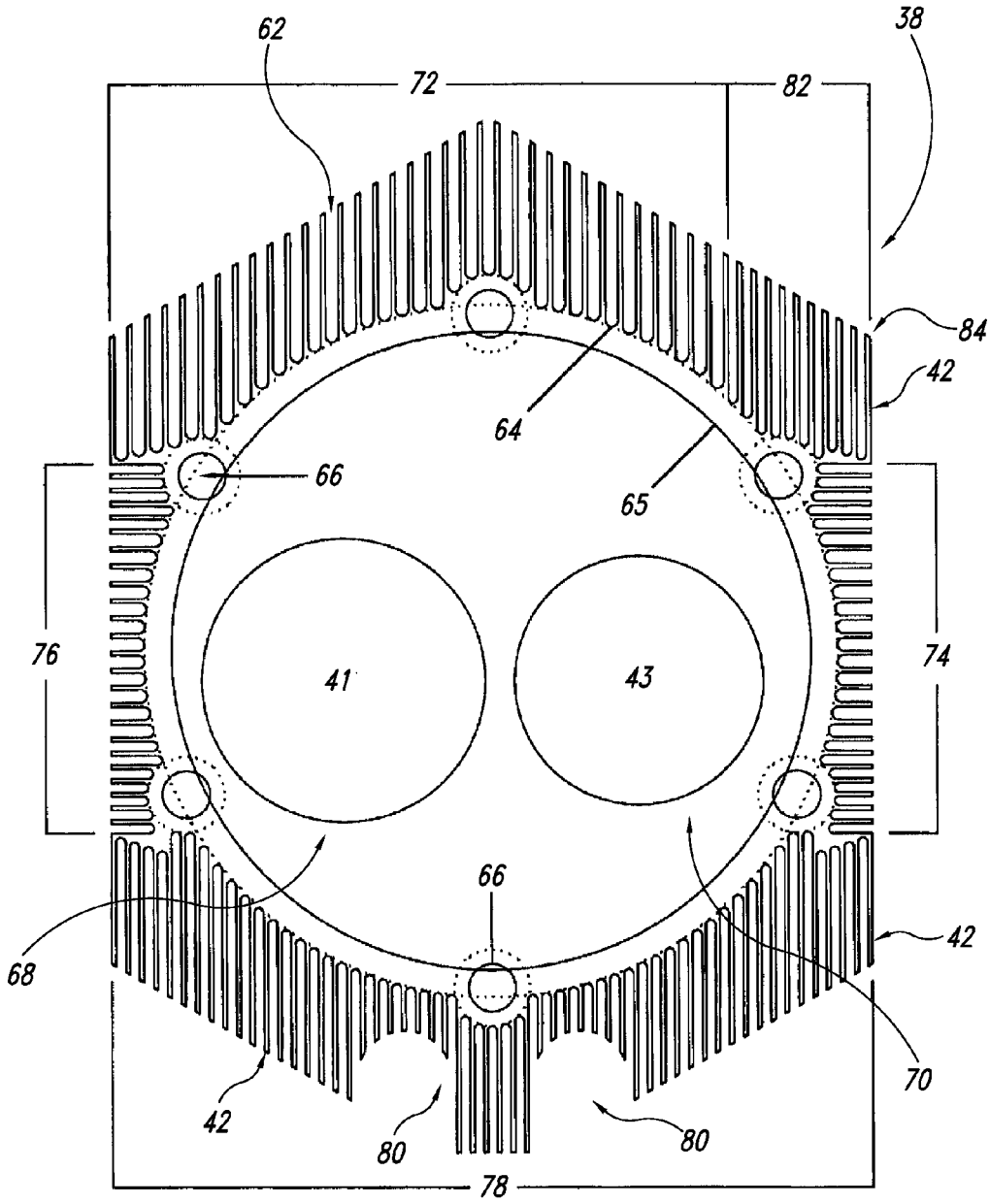
FIG. 3 is an end view of the head of FIG. 2 as seen from the cylinder showing the distribution of fins around the combustion chamber.

FIG. 3 shows the surface of the head 38 that faces the cylinder 40 in FIG. 2 with the intake valve 41 and the exhaust valve 43. The entire periphery of the head 38 is surrounded by the head fins 42 that form channels 62 therebetween. The bottoms 64 of the channels 62 between the head fins 42 leave adequate material to provide strength around the edge of the cutout 65 where the head 38 surrounds the top edge of the cylinder (40 in FIG. 2) and around the holes 66 for the six head bolts (not shown). Although it is not obvious in this view, there is an important distinction between the intake valve side 68 of the head 38 and the exhaust valve side 70 of the head 38.

The entire periphery of the head 38 is covered by the head fins 42, with the fins 42 divided into several functional groups. Combustion chamber fins 72 shown near the top of FIG. 3 cool the dome and upper edge of the combustion chamber. Exhaust side fins 74 shown on the right side of FIG. 3 cool the very high heat load of the exhaust port and the exhaust side edge of the combustion chamber. Intake side fins 76 shown on the left side of FIG. 3 primarily cool the intake side edge of the combustion chamber, the intake port not generating any heat. Bottom fins 78 shown at the bottom of FIG. 3 cool the bottom edge of the combustion chamber. Notice that bottom fins 78 have two cut outs 80 to provide clearance for push rod tubes (not shown). This leaves the fins 82 in one corner 84, which provide some cooling to that edge of the combustion chamber but whose primary purpose is to provide a suitable quantity of cooling air to the region of the cylinder (40 in FIG. 2) that is aligned with them.

This is a convenient set of fin groups that facilitate discussion. All fins are part of one big block of metal and heat will tend to distribute itself to the coolest fins. The region of the exhaust port has the highest heat load in the entire engine. Obviously some combustion chamber fins 72 and bottom fins 78 that happen to pass close to the exhaust port will help cool the exhaust port.

In addition to the fins shown here, it is entirely possible, and desirable, to drill a set of holes vertically thru the metal separating the intake and exhaust ports. Such holes, properly aligned, can provide the air flow to the central couple of grooves between the combustion chamber fins 72. Blocking, or partially blocking, the entry to the grooves 62 between these central fins, near the rocker arm housing (54 in FIG. 2) will force air to flow thru these holes between the intake and exhaust ports. Thus, they will provide very significant cooling to the exhaust port and also provide thermal isolation between the exhaust port and the intake port (which should be kept cool for optimum engine performance). The present Jabiru heads use such a set of holes. This is not a new innovation herein, but it is applicable to the axial flow cooling design. Because such holes are used in the present Jabiru heads, it is not necessary to confuse these drawings by including the holes in these drawings.

Since the exhaust port quadrant of the head has about twice the thermal loading of any other quadrant, it might seem reasonable to make the head nonsymmetrical around the axis of the cylinder, with longer fins on the exhaust port side than on the intake port side. In fact, early Jabiru engines were made that way. Apparently Jabiru learned that this did not work well. Actually, that approach is counterproductive in a transverse cooling system. It results in little or no cooling on the edge of the combustion chamber at the intake port side.

In an axial flow cooling system, as described herein, some modest performance improvement can be achieved by making the heads slightly asymmetrical. They should not be so asymmetrical as to eliminate the cooling fins from the intake side of the combustion chamber, which could cause overheating in that part of the head.

Figure 11:
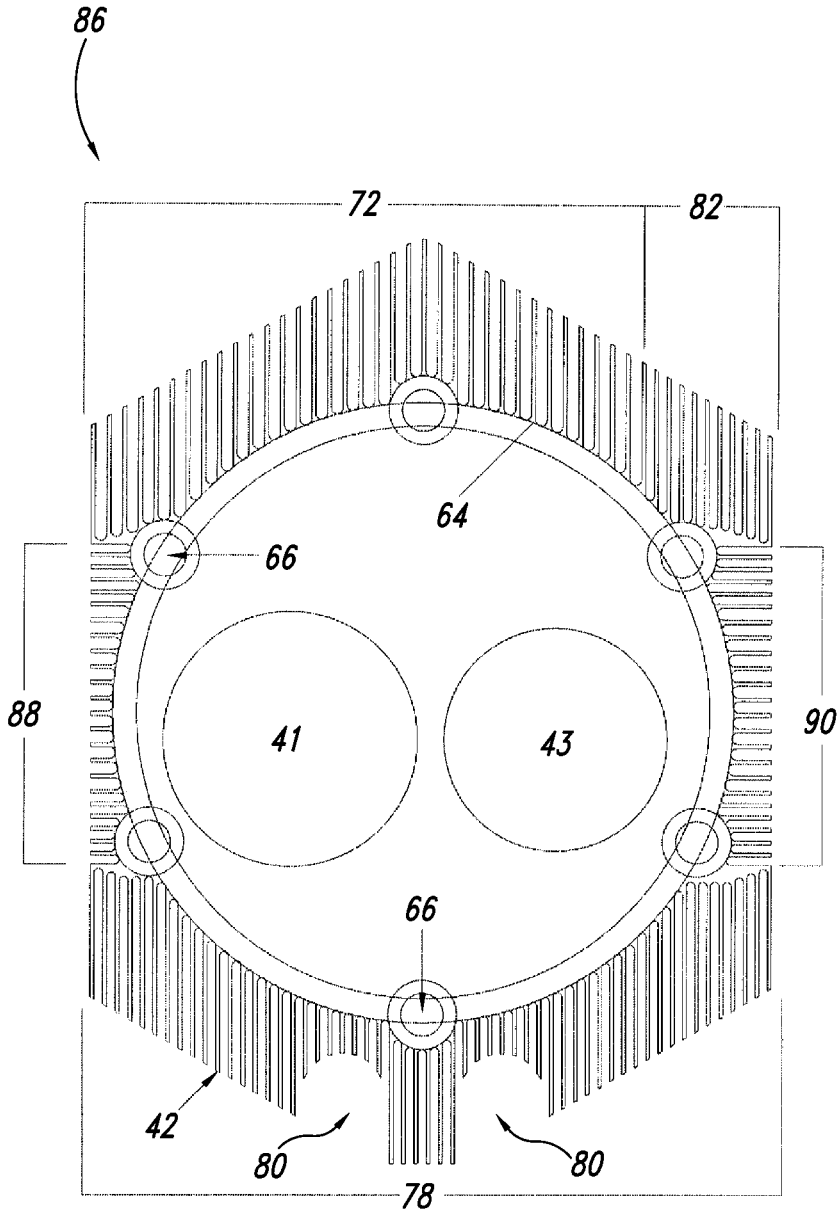
FIG. 11 is a detail of an asymmetrical head formed with more fin area near the thermally stressed exhaust port in accordance with an alternative embodiment of the present disclosure.

The small asymmetry of the head is most easily seen by looking at FIG. 11, in which is shown the face of an asymmetrical head 86 that is adjacent to the cylinder. Reducing the heights of the intake side fins 88, and increasing the heights of the much longer (in the direction of air flow) fins 90 on the exhaust side results in more total fin area (which is not the case in a transverse flow head made asymmetrical), a greater increase in fin area near the critical exhaust port, lower maximum temperatures near the exhaust port, and more even temperature distribution over all parts of the head.

There is a potential disadvantage to asymmetrical heads from the point of view of engine maintenance. While the heat load on the cylinder is relatively even, and the fins are symmetrical around the vertical centerline, an asymmetrical head occupies more space on the exhaust side of the cylinder right-left centerline 52 (shown in FIG. 7) than on the intake side of the cylinder right-left centerline 52, and thus overhangs an adjacent cylinder. It can become impossible to remove some individual cylinders without removing two heads if the heads are significantly asymmetrical.

Figure 4:
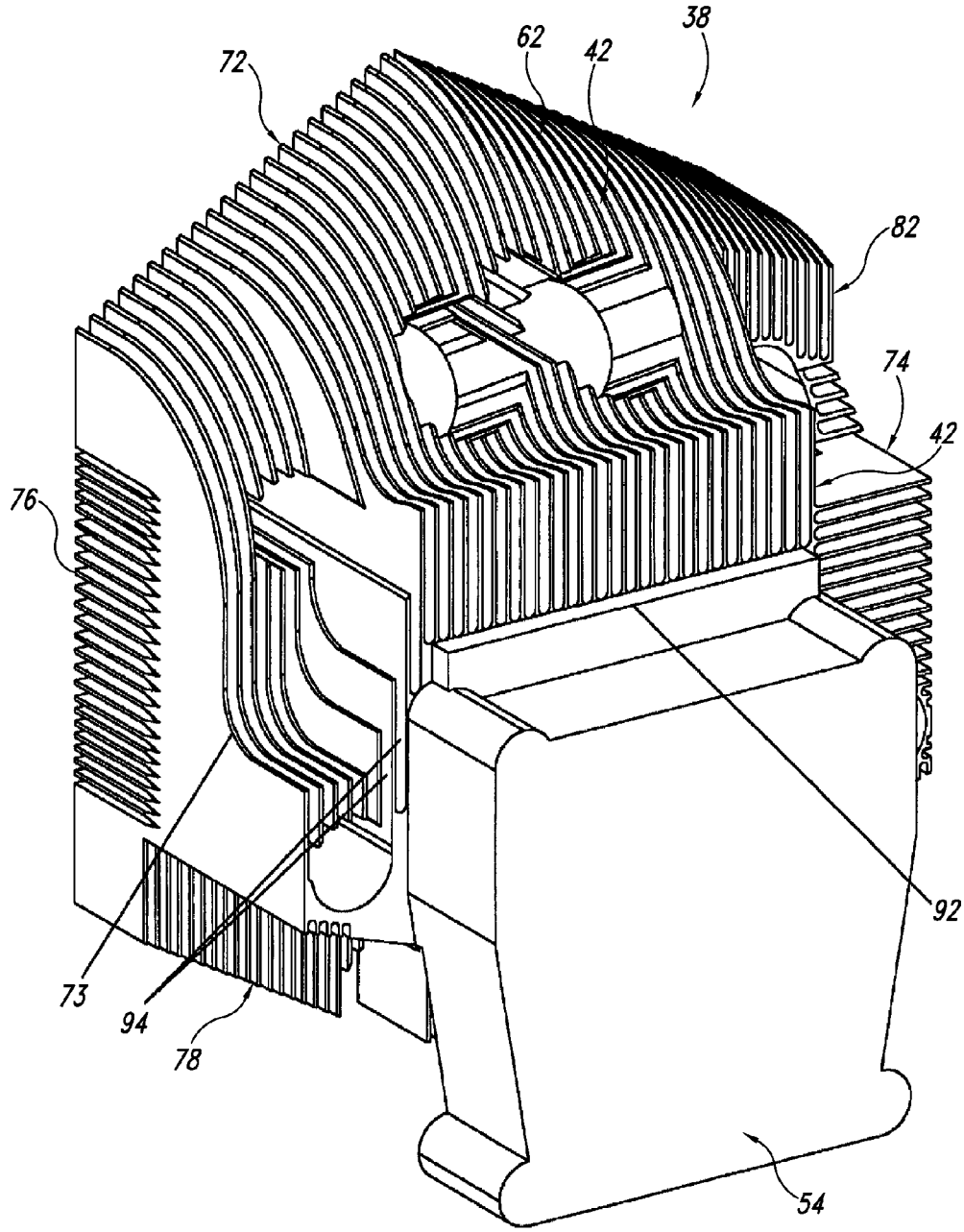
FIG. 4 is a trimetric view of the head of FIG. 2 showing the fins on the intake port side and top of the head and a few fins on the bottom of the head.

FIG. 4 is a trimetric view of the head 38, seen from the intake port side. This is an identical view of the head 38 as shown in FIG. 2, but the view is twice as large. Clearly it is unacceptable for the grooves 62 between the head fins 42 to cut into any internal features of the head 38. Air enters most combustion chamber fins 72 just above the rocker arm housing 54. These cannot be cut any deeper without penetrating the oil supply manifold 92 for the rocker arms. A few combustion chamber fins 73 near the intake port can be cut much deeper for considerable weight savings. Two of the grooves 94 between the combustion chamber fins 73 cannot be cut as deep as might be expected without cutting into the intake port (internal to the head).

It is blatantly obvious that intake side fins 76 have no direct access to the cooling air input. This is a significant part of the design, not an unforeseen problem. The function becomes clear in the discussion of FIGS. 5 and 6 below. The exhaust side fins 74 and the corner fins 82 can be seen. They will be discussed further with FIG. 5.

The bottom fins 78 have a flow path length of only about 20 mm. They cool little more than the bottom edge of the combustion chamber. The volume between the bottom fins 78 and the rocker arm housing 54 is occupied by the intake pipe (not shown). The bottom fins 78 cannot be made longer on this side. There is no real need for the cooling on this side. On the exhaust side, where more cooling would be very desirable, the exhaust pipe does not allow a longer flow path thru the bottom fins 78. In the middle, hidden behind the rocker arm housing 54, resides the sixth head bolt (not visible). Access for machining that area and installing that bolt does not allow a longer flow path length for the bottom fins 78 in that region. Although the bottom fins 78 do little cooling, they are necessary for delivering a proper quantity of air to cool the bottom of the cylinder (40 in FIG. 2).

Clearly, all head fins are working in parallel. The pressure drop across all flow paths is the same. Most of the pressure drop will occur across the head 38. The cylinder fins 44 are relatively widely spaced, creating less pressure drop. In order to prevent the short path length of the bottom fins 78 from carrying a disproportionally large fraction of the total air flow, the spacing between the bottom fins 78 should be smaller than other fins, (creating more drag), or the bottom fins 78 should be thicker than other fins (occupying more of the cross section), or the bottom fins 78 should be less high than other fins (giving less area for the air to flow thru), or any combination of these three parameters.

Figure 5:
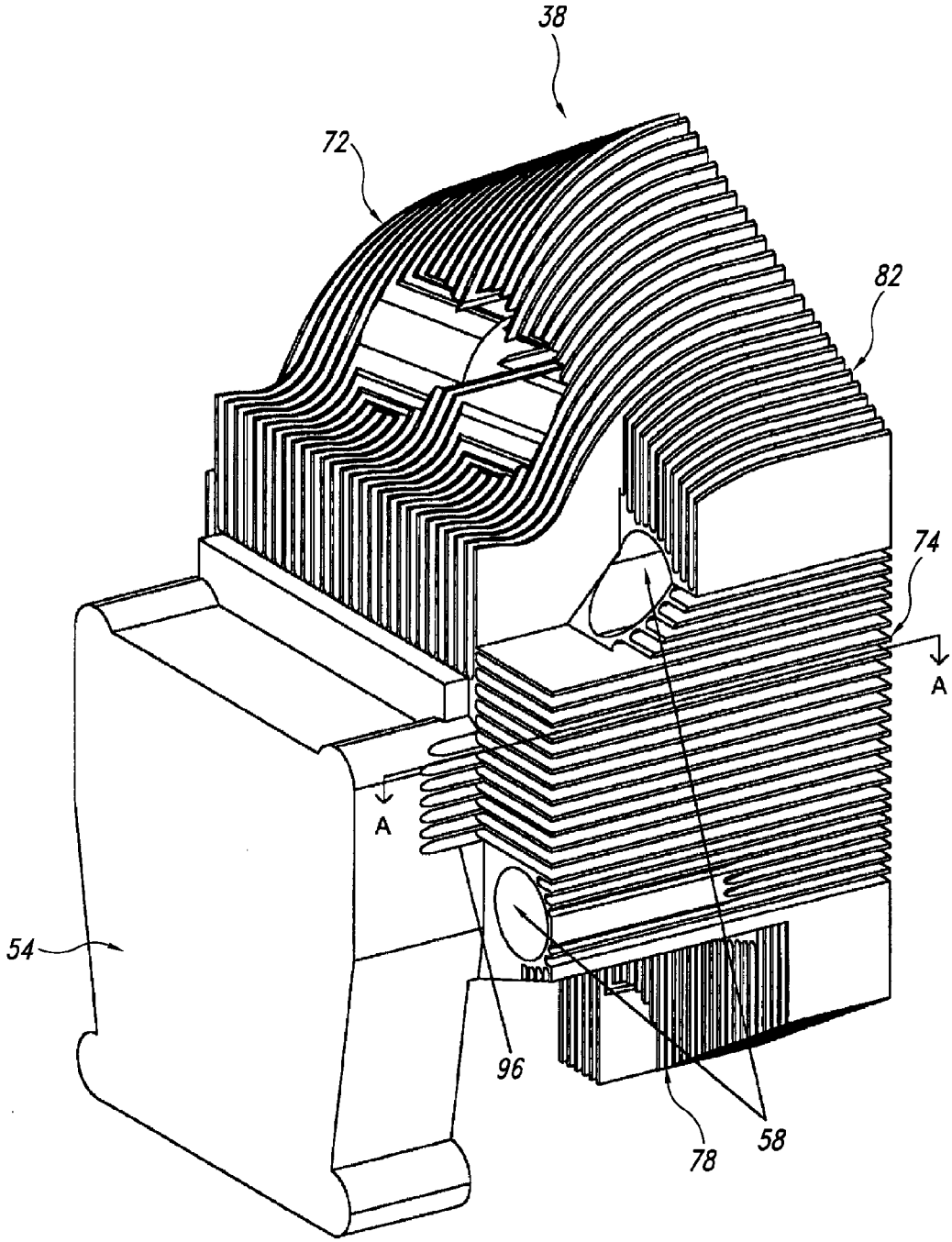
FIG. 5 is a trimetric view of the head of FIG. 2 showing the fins on the exhaust port side and top of the head and some of the fins on the bottom of the head.

FIG. 5 is the same scale and perspective as FIG. 4 except that the head 38 is rotated 90° around a vertical axis. This is the best view to show how the combustion chamber fins 72 wrap smoothly over the dome and upper edge of the combustion chamber. Note that the combustion chamber fins 72 act as many little beams that strengthen and stiffen the dome of the combustion chamber. Fins cut for transverse cooling tend to cut the dome of the combustion chamber away from the mounting surfaces, thus weakening it to the maximum possible extent. FIG. 5 also shows that all of the bottom fins 78 have the same short air flow path length. Note that near the side of the head 38 it is possible to machine very short bottom fins that will dissipate some heat into the air that is flowing thru the region. These short fins lie outside the mounting of the exhaust pipe (not shown). Where cooling is critical, every little bit helps. Note that the corner fins 82 also have a short air flow path length, about half as long as the combustion chamber fins 72 and the exhaust side fins 74, but about twice as long as the bottom fins 78.

The dramatic thing shown in FIG. 5 is the height of the exhaust side fins 74. Every exhaust side fin 74 in the central section is 25 mm high. The height of the exhaust side fins 74 is maximized by cutting some grooves 96 into the side of the rocker arm housing 54, but not deeply enough to compromise its function. As the air approaches the cylinder 40, it is pushed outboard, away from the axis of the cylinder 40, in order to clear the bottom of the combustion chamber. This is the region where the side fins 74 and 76 can be only 5 to 10 mm deep. However, this is the region where the intake side fins 76 on the adjacent head have no air supply other than that flowing out of the mating exhaust side fins 74. Including the nominal clearance of nearly 2 mm between heads, the minimum total fin height for the air passages between heads is almost 12 mm, and the average is over 15 mm. The air path length thru the restriction is only a couple cm. Thus it does not represent a major impediment to the flow of air. Also, the restriction affects only the air flowing thru a few side fins, not the entire cooling air flow for the head 38. The air flowing thru the combustion chamber fins 72, the bottom fins 78, and the corner fins 82 is not affected by the close spacing of the cylinders 40 and the heads 38.

The air paths are more restricted where the air must flow around the head bolts (hidden within the fins) at the bottoms of the head bolt cutouts 58. As the exhaust side fins 74 pass the head bolt cutouts 58, the fin height is small to nonexistent. Closer to the cylinder (40 in FIG. 2), the exhaust side fins 74 are considerably taller, and the grooves between the exhaust side fins 74 penetrate into head bolt cutouts 58. This allows air to flow thru head bolt cutouts 58, modestly cooling the walls of the cutouts 58 and providing additional air to fill the deeper grooves between the exhaust side fins 74. Despite the best of efforts, the regions of the cylinders 40 immediately below the four side head bolts will receive the least air and will probably be the hottest areas on the cylinders, especially near the head bolt beside the exhaust port. Still, with axial cooling, temperature variations in various parts of the engine are practically insignificant compared to the temperature variations encountered in the present Jabiru engines.

Figure 6:
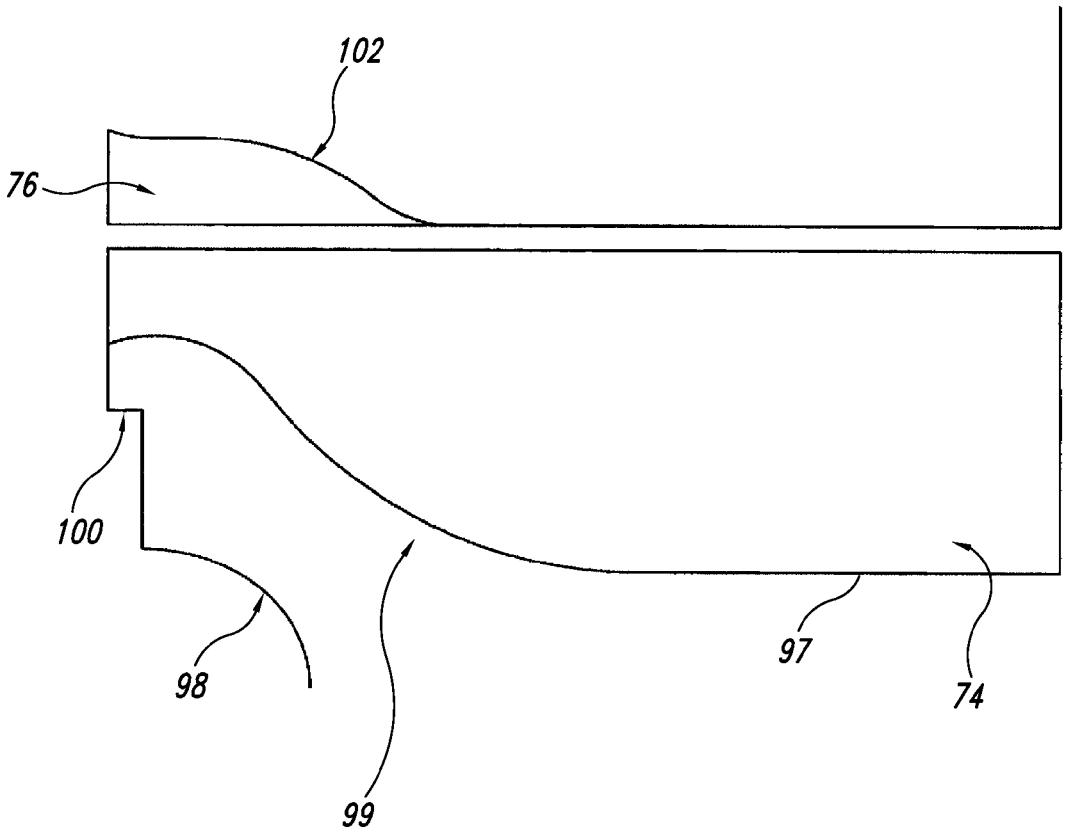
FIG. 6 is a top view of a section of two adjacent heads showing the air flow path between them in accordance with the present disclosure.

The air path thru the side fins is clearly shown in FIG. 6, which is a section view of the exhaust fins 74 and the intake fins 76 of an adjacent head, denoted as A-A in FIG. 5. This is a fairly average flow channel between the heads, neither the most restricted nor the least restricted. Air enters the exhaust fins 74 from the right. As the air flows toward the left, the bottom 97 of the exhaust side groove 99 curves to stay away from the edge of the combustion chamber 98 and cylinder cutout 100. As the air is pushed up (in this view), it enters into the intake side groove 102 between the intake side fins 76 of the adjacent head. For this particular groove, the minimum total fin height is 14.6 mm, and the total fin height is under 20 mm for a path length of about 22 mm. Thus peak flow velocity is less than double the minimum flow velocity, and it exceeds 125% of the minimum flow velocity for a distance of less than ⅓ of the total path thru head 38.

At one end of the engine, the exhaust side fins 74 will not have mating intake side fins 76 to carry cooling air past the edge of the combustion chamber 98. At the other end of the engine, there will be no exhaust side fins 74 to supply intake side fins 76 with cooling air. If the cooling air duct fits tightly to the heads at the ends of the engine, then the exhaust side fins 74 suffer a severe restriction in their air flow path, and the intake side fins 76 will receive no cooling air. It is a simple matter of shaping the cooling air ducts to provide suitable passages and air flow to resolve this situation.

Figure 7:
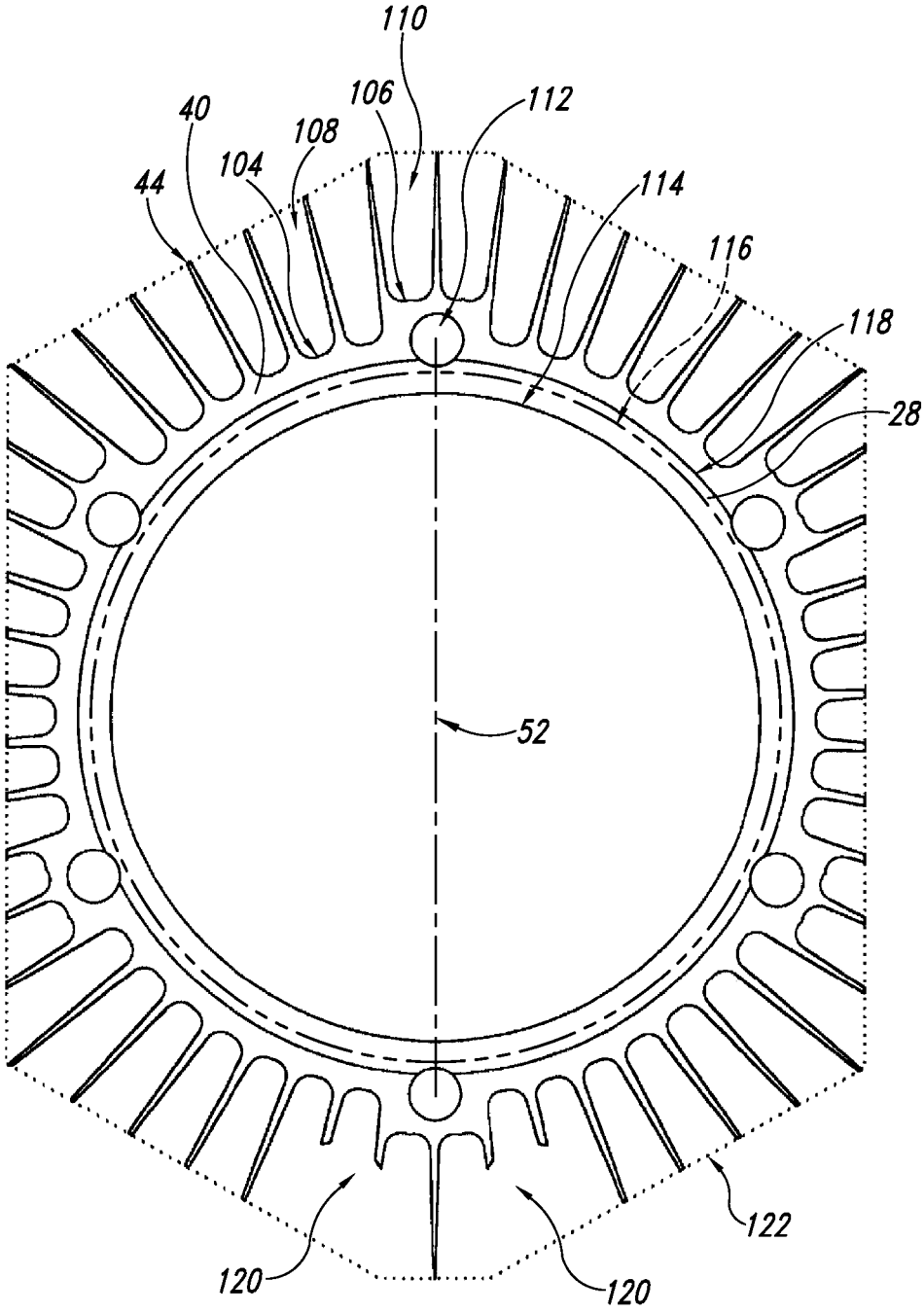
FIG. 7 is an end view of the cylinder of FIG. 6 as seen from the head showing the fins surrounding the cylinder.

FIG. 7 shows the surface of cylinder 40 that faces the head 38 in FIG. 2. FIG. 7 is symmetrical around the cylinder right-left centerline 52. To improve fin efficiency, the cylinder fins 44 are tapered. Neither of these characteristics is of fundamental importance to the principles of axial flow cooling. Because the heat loading of the cylinder 40 is not as great as that of the head (38 in FIG. 2), the cylinder fins 44 are more widely spaced, saving weight and manufacturing cost and reducing the pressure drop across the cylinder 40. The bottoms 104 and 106 of the grooves 108 and 110, respectively, between the cylinder fins 44 are aligned to the heights and slopes of the bottoms of the grooves between the head fins (62 in FIG. 3). This minimizes turbulence and its resulting pressure drop. In other words, the bottoms of the head and cylinder grooves are the same heights and slopes to reduce turbulence and drag at the transition between the two. This means only that it is desirable to align the heights and slopes of the groove bottoms. It is still desirable that there be no relation between the locations and angles of the head and cylinder fins in order to disrupt the boundary layers.

The bottoms of the grooves 106 are high enough at the face of the cylinder 40 that there is adequate strength around the threaded holes 112 into which the head bolts (not shown) are screwed. The inside circumference 114 of the bore of the cylinder 40, the outside circumference 116 of the cylinder 40 near the crankcase (50 in FIG. 2), and an outside circumference 118 of a spigot 28 of the cylinder 40 where it mates with the head 38 are unchanged from the standard Jabiru cylinders. Cutouts 120 in the fins 44 are provided for clearance around the push rod tubes (not shown). The envelope 122 of the cylinder fins 44 is essentially the same as that of the head fins 42, facilitating construction of the duct (not shown) surrounding the cylinder 40 and the head 38, and minimizing turbulence losses at the interface between the cylinder 40 and the head 38.

Note that both the head 38 (as shown in FIG. 2) and the cylinder 40 (as shown in FIG. 7) have cutouts 80 and 120, respectively, in the fins where the push rod tubes (not shown) reside. Note also that the cooling air flow is coaxial with the push rod tubes. This will make a significant contribution toward meeting the total oil cooling requirement. In most air-cooled engines, the engine cooling air flow largely misses the push rod tubes and makes no significant contribution toward cooling the oil.

Figure 8:
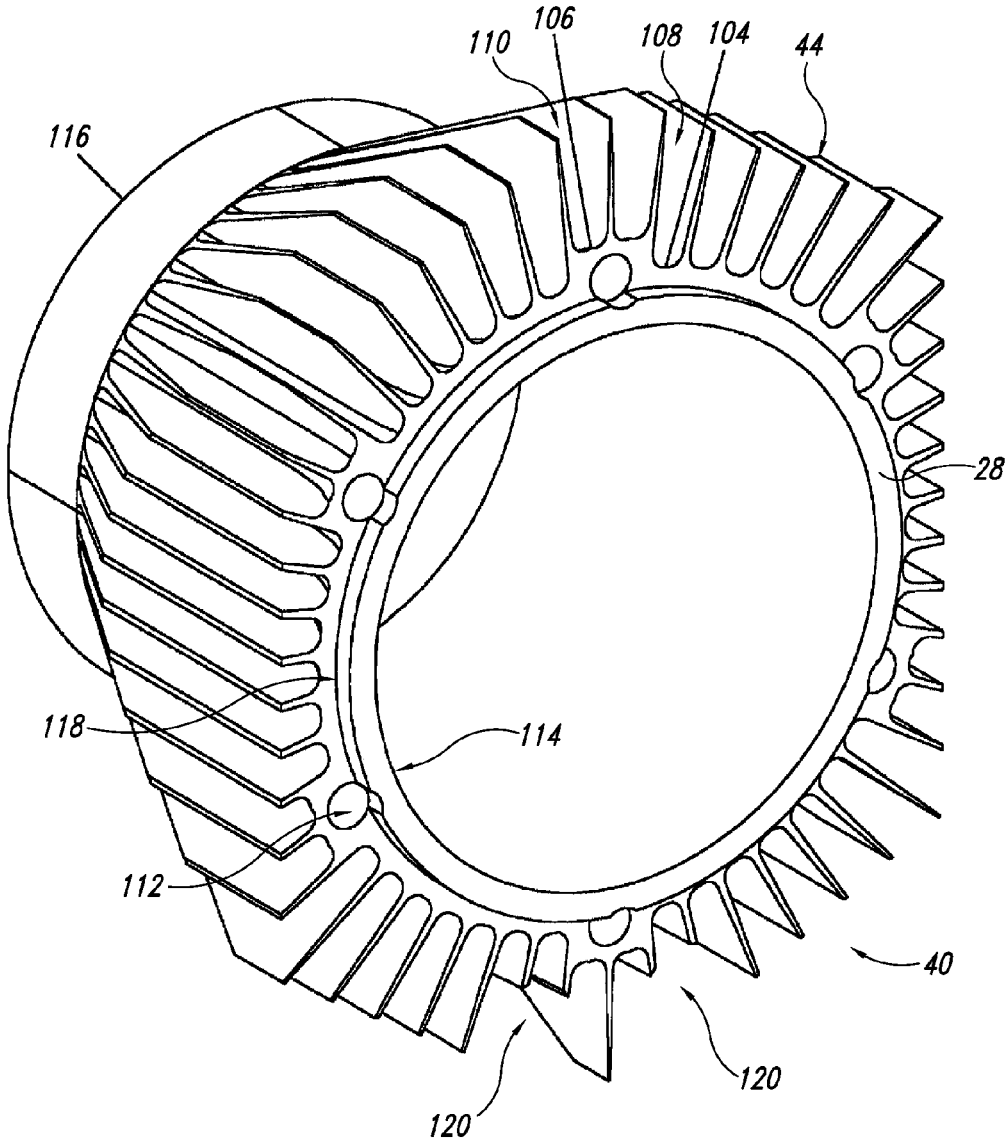
FIG. 8 is a trimetric view of the cylinder showing how the fins are distributed along the length of the cylinder.

FIG. 8 is a trimetric view of the cylinder 40, identical to that in FIG. 2, except twice as large and not partially obscured by the head (38 in FIG. 2). FIG. 8 shows the fins 44, grooves 104 and 106, spigot 28, threaded holes 112, diameters 114, 116, and 118, and cutouts 120, as in FIG. 7. To reduce drag on the cooling air, the cylinder fins 44 are full height only near the head 38, where the heat loading is greatest. They taper to zero height near the crankcase (50 in FIG. 2). For ease of manufacture, the envelope of this tapered region is a cone. The bottoms 104, 106 of the grooves 108, 110 lie on a circumference 124 for most of the length of the grooves. As the grooves 104 and 106 approach the head 38, the bottoms 104, 106 of the grooves 108, 110 curve to make a smooth transition to the grooves between the head fins (42 in FIG. 2). These features improve performance or reduce manufacturing cost or both.

While these drawings show rectangular fins on the head and tapered fins on the cylinder, the concept of axial flow is not dependant on any fin shape. Any given fin may be rectangular, tapered, or irregular. The shape is dictated more by manufacturing ease than any other consideration.

Comparing FIGS. 3 and 7, it is obvious that there is no coherence whatsoever between the locations and orientations of the head fins 42 and the cylinder fins 44. This is desirable in that it interrupts the boundary layer that forms over a continuous surface, the boundary layers reducing the thermal conductivity from the surface to the air flowing over it. With the discontinuity in the fin surfaces between the head 38 and the cylinder 40, when the cooling air reaches the cylinder fins 44, the boundary layer has to start over at essentially zero thickness. Thus the flow path length over the cylinder fins 44 and most of the head fins 42 are in the range of 65 to 75 mm. Some of the head fins 42 are considerably shorter than this. This is much shorter than the typical 235 mm length of fins in the present Jabiru engine. The thermodynamic ideal for fin length is a few mm, so any shortening of the fins (in the direction of air flow) is advantageous. The average reduction of fin length achieved with axial flow design is a very significant improvement in itself. That is in addition to the more even distribution of air over the fins and the reduced pressure required to drive sufficient air over the fins. Part of this reduction in fin length comes with the cost of added turbulence and drag at the discontinuity between the head fins 42 and cylinder fins 44. Fin lengths will vary with engine size and design details, but air flow path lengths over axial fins will always be much shorter than such path lengths over transverse fins suitable for the same engine.

Figure 9:
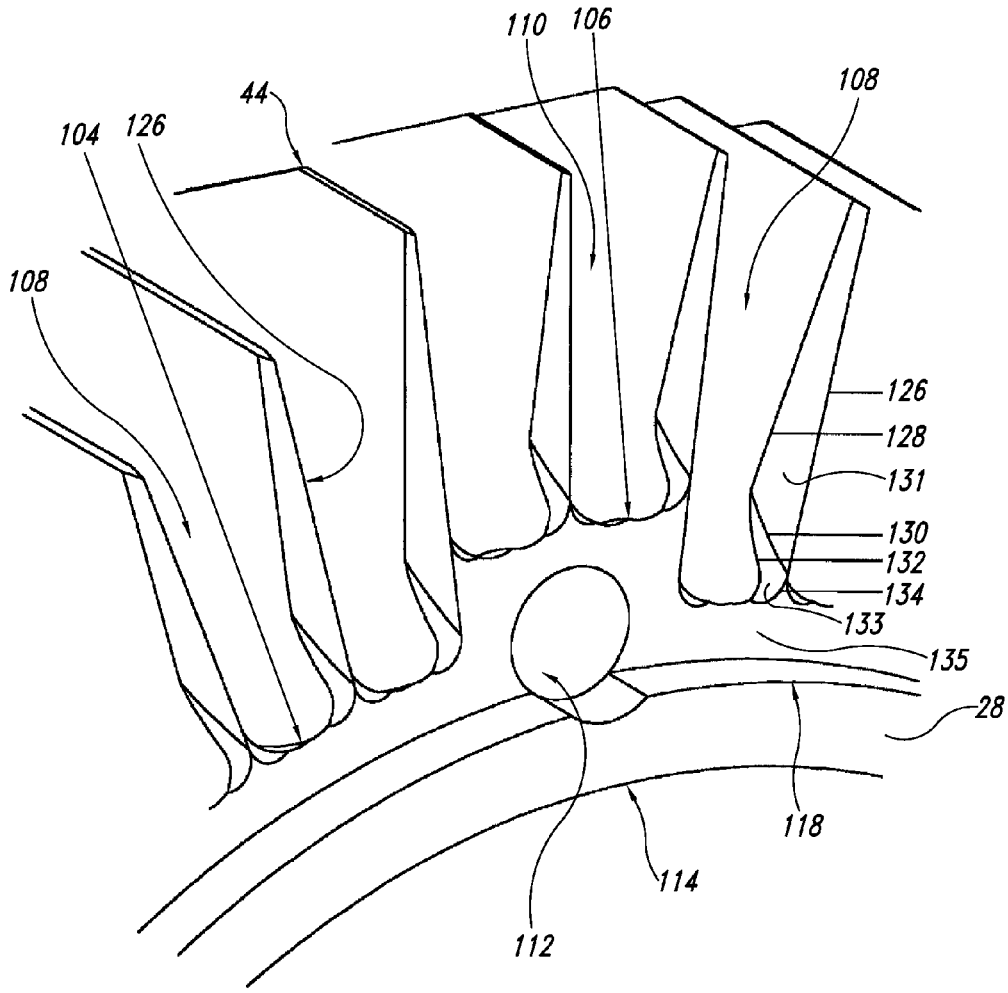
FIG. 9 is a detail of the ends of the cylinder fins showing the results of machining them with sharpened edges in accordance with the present disclosure.

To greatly reduce this effect, the leading edges 126 of the cylinder fins 44 are sharpened, as shown in FIG. 9. This is a detail showing only a few fins. An easy way to create the sharp leading edge 126 is with two small saw cuts for each fin 44 using a saw blade that cuts a round bottomed groove. FIG. 9 shows one threaded head bolt hole 112, the wall 114 of the cylinder bore 24, and the outside circumference 118 of the spigot 28 of the cylinder insert into the head 38. Between the fins 44 are the grooves 108, 110, showing both depths, and demonstrating that the leading edges 126 of all fins 44 can be sharpened. In FIG. 9, the leading edge 126 is brought to a knife edge. This is probably not a satisfactory solution, for safety reasons, but it demonstrates the process and it is by far the easiest to draw and understand. The intersection 128 is shown between the original surface of the fin 44 and the slope to the leading edge 126, and the intersection 130 is shown between the flat side 131 of the cut and a round bottom 133. The intersection 132 is shown between the round bottom 133 of the sharpening cut and the round bottom 104 of the deep groove 108 or bottom 106 of groove 110, and the intersection 134 is shown between the face 135 of the cylinder 40 and the round bottom 133 of the sharpening cut.

It is also desirable to sharpen the trailing edges of the cylinder fins 44 and the leading and trailing edges of the head fins 42. However, both these steps are significantly more difficult to implement, and the improvement is significantly less than is gained with sharpening the leading edges of the cylinder fins 44. Consequently it is probably not worthwhile except in extreme conditions, such as airplane racing.

Figure 10:
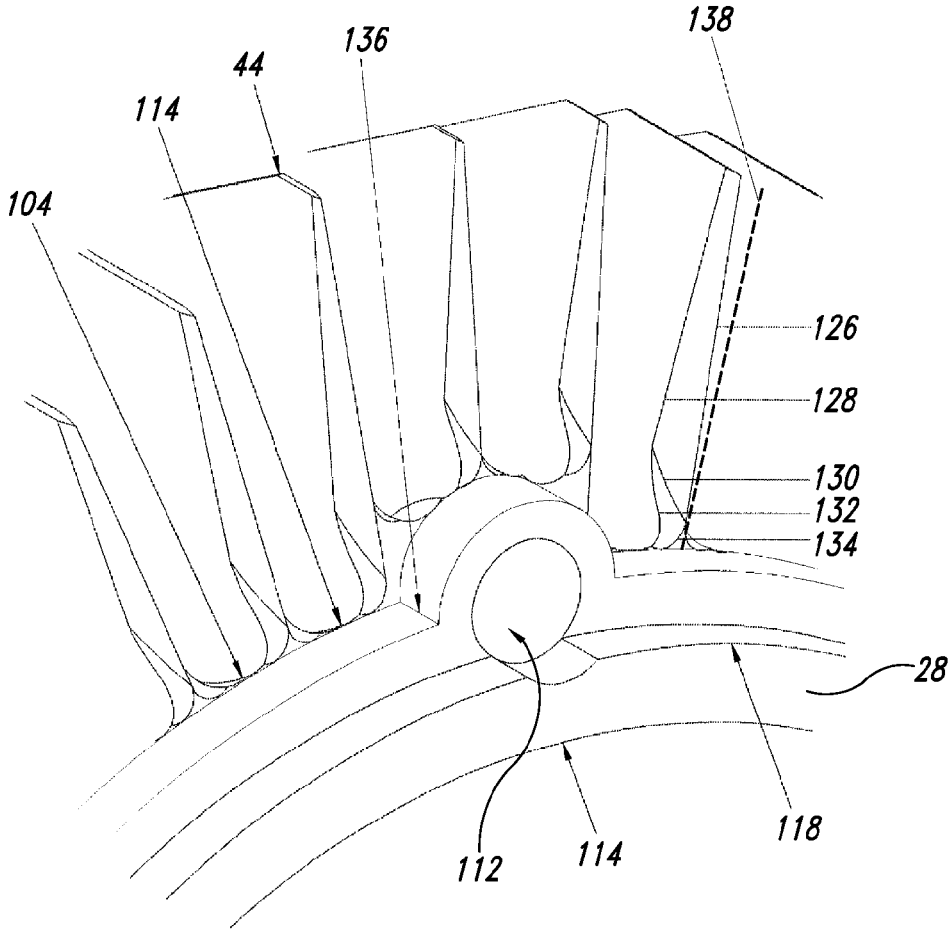
FIG. 10 is a detail of cylinder fins formed with a gap between them and the head fins to smooth the air flow as it makes its transition from the head to the cylinder in accordance with an alternative embodiment of the present disclosure.

The transition of the cooling air from the head 38 to the cylinder 40 is made smoother by introducing a transition region in which there are no fins. This is done by recessing fins at the top of the cylinder 40, as shown in FIG. 10. FIG. 10 shows all the same parts of the cylinder 40 as are shown in FIG. 9.

Comparing FIG. 10 with FIG. 9, it is apparent that in FIG. 10, the fins 44 do not extend as close to the top of cylinder 40 as they do in FIG. 9. This can be done in a variety of ways, and the manufacturing technique is unimportant. The leading edge 126 of cylinder fins 44 can be made perpendicular to the axis of cylinder 40, which makes a constant gap between head 38 and cylinder fins 44. Alternatively, the leading edge 126 of the fins 44 lies in the surface of a cone, there being a gap from the head 38 at the top of the fins 44 but not at the base of the fins 44. As another alternative, the entire leading edge 126 of the fins 44 has a gap from the head 38, and this gap increases with fin height, as shown in FIG. 10. Here the leading edge 126 of the base of the fins 44 is set away from the head 38 by an additional short distance 136, typically a few mm and preferably a distance greater than 1 mm. The leading edges 126 of the cylinder fins 44 are also sloped back from the head 38, as is apparent when compared to the dashed line 138, which is radial from the axis of the cylinder 40.

Fin efficiency of the cylinder fins 44 is high, so sloping the leading edge of the cylinder fins 44 has no significant effect on the cooling achieved by these fins, provided the fins 44 extend further down the barrel of the cylinder 44 to maintain a constant fin surface area.

It is structurally possible to terminate the head fins 42 above the bottom surface of the head 38, thus creating a transition gap between the head fins 42 and the cylinder fins 44. However, the head 38 is far more thermally stressed than the cylinder 40, so it is important to maximize the surface area of the head fins 42.

Ducts (not shown) for containing cooling air within the axial flow fins are considerably simpler than ducts presently used in low drag down-draft cooling installations. A three piece duct is adequate for each side of the engine. One piece extends over the cylinders and heads from the crankcase to the spark plugs. A second piece extends under the cylinders from the intake and exhaust pipes to a few cm from the crankcase, leaving ample space for the hot air to exit downward. Ideally, this second piece is connected to a plenum under the engine which guides the heated air toward the outlet port. The third piece of duct extends from the spark plugs, over the rocker covers, to the intake and exhaust pipes, connecting to the first and second pieces. The third piece also incorporates the nozzle that picks up the intake cooling air. A wide variety of duct configurations will work with an axially cooled engine. This is just one example of a simple, effective duct that allows easy access to the engine.

Cooling ducts for axial flow cooling are not shown. The required shape of such cooling ducts is obvious. An optimized duct will contain a diffuser and turning vanes. These features are well known in duct design.

Definition

Fin Efficiency: The heat flow rate from a given fin divided by the heat flow rate that would occur if the fin had an infinite thermal conductivity, all other parameters remaining unchanged.

High fin efficiency sounds good, but it requires a lot of fin material and large volumes of space in which to locate it. In real situations, for almost any definition of "optimum", the most desirable fin efficiencies are in the vicinity of 70%.

Experimental Results

Thermal measurements on a Jabiru engine in a laboratory indicate that it is probably impossible to operate the engine continuously at rated power in any existing airplane. These measurements, with very good ducts distributing cooling air over the heads, indicate a quiescent temperature rise of 300° C. when operated in a normal small plane. There is not enough pressure available at speeds small airplanes can realistically achieve to force enough air thru the engine to keep it cool, especially on a warm day. It will barely survive at 70% cruise power. The condition of used heads from Jabiru engines is testimony to the difficulty of keeping the engine at a reasonable operating temperature. There are two major problems, fin area and air flow velocity. A Jabiru head has about 1500 $cm^2$ of surface area actually exposed to moving air, and over much of that area the air movement is sluggish. The fin efficiency of the Jabiru engine is very high, above 95%, but this does little good because there is so little fin area and the cooling air cannot effectively reach much of the area that does exist.

By comparison, the head disclosed herein has a fin surface area of about 2700 $cm^2$, 1.8 times as much, and all fit within the same volume. More important, the air flows evenly over essentially all of that area, cutting thermal resistance from the fin to the air to a fraction of the value in the present Jabiru engine. While this is important, even more important is the fact that the pressure required to drive air thru the head fin assembly is dramatically lower. Tests on a flow bench with a mockup of the head fins demonstrated herein show that for any given volume flow rate, the pressure drop of this design is well under 10% that of the present Jabiru design. Thus, there is adequate air pressure available to cool the head to a comfortable temperature even at full power and low speeds, as in a prolonged, steep climb. Not only does this promote engine reliability, it dramatically reduces cooling drag, which takes a significant fraction of the total engine output power. The result is higher speed and better fuel economy.

The fin efficiency in this design is over 75%. This is a little higher than optimum, but cutting thinner fins and making more of them would be difficult.

Design changes made by the Jabiru factory after this patent application was first submitted to USPTO have greatly increased the head fin area of the Jabiru engines, approaching the fin area of the heads presented herein. However, these design changes by Jabiru have done nothing to increase the air flow rate over the fins, and it does not change the fact that large areas of the fins have no significant air flow over them.

Range of Applications

This detailed description of axial cooling has been applied to the Jabiru engine. The Jabiru was selected as a model because its compact design exacerbates the cooling problems present in all air-cooled engines. Clearly a similar design process will result in improved cooling for other existing engines, and new engines that may be designed in the future.

Axial cooling is most applicable to horizontally opposed engines of more than two cylinders. It can be used in 2-cylinder horizontally opposed engines, but the advantages are limited. At this time, there are very few in-line air-cooled engines. Axial cooling is applicable to in-line engines. Most V engines of more than two cylinders are water cooled, but an axial-flow, air-cooled V engine is certainly possible, with air entering above the engine, flowing down thru the head and cylinder fins, and exiting at the two sides of the crankcase. In radial engines, as in 2-cylinder horizontally opposed engines, axial flow cooling could be used, but the advantages are limited. The real advantages of axial flow cooling occur in configurations where there is limited space for air to pass between adjacent heads and cylinders, and it is advantageous in any such engine.

Axial flow cooling is applicable to stationary installations with a fan providing the driving power to the cooling air, to mobile installations where the motion of the vehicle causes the cooling air to flow over the engine, and to mobile installations where a fan (or propeller) is used to augment the airflow caused by the motion of the vehicle. As mentioned above, exhaust augmentation of the cooling flow is also possible and desirable with axial flow cooling.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims and the equivalents thereof.

The invention claimed is:

1. A head for an air-cooled engine having at least two cylinders, each cylinder having a longitudinal axis, the head having a rocker arm mounted to rotate about a rocker arm axis in the head, the head further including an intake port and an exhaust port, and the head mounted on a first cylinder of the two cylinders to define a combustion chamber, the head comprising:

at least two fins, each fin having a height-to-thickness ratio of greater than or equal to 5, each fin having a length that is at least 5 times the distance between the at least two fins at a location on the head that is between the first cylinder and the rocker arm axis on the head, and each fin positioned on the head with the fin length oriented along an axis that is substantially parallel to the longitudinal axis of the first cylinder.

2. The head of claim 1 wherein more total fin surface area is provided near the exhaust port than near the intake port in the head.

3. The head of claim 1 wherein the head occupies more space on an the exhaust side of the cylinder longitudinal axis than on an intake side of the cylinder longitudinal axis to provide additional space for additional cooling fins that are positioned in an area adjacent the exhaust port.

4. The head of claim 1, further comprising fins on the head that are positioned over at least a portion of the combustion chamber.

5. The head of claim 1 wherein the thickness of each fin is constant from 10% of the fin height to 90% of the fin height.

6. The head of claim 1 wherein each fin has a thickness that is greater than the average thickness at 10% of the fin height and a thickness that is less than the average thickness at 90% of the fin height.

7. The head of claim 1 wherein each fin has a free end that has a shape that is more aerodynamic than a fin end that is square.

8. A cylinder for an air-cooled engine having at least two cylinders, the cylinder comprising:

a longitudinal axis and at least one pair of fins, each fin having a height-to-thickness ratio of at least 5 for a length of at least 0.1 times a length of the cylinder, the pair of fins oriented substantially parallel to the longitudinal axis of the cylinder.

9. The cylinder of claim 8 wherein the thickness of each fin is constant from 10% of the fin height to 90% of the fin height.

10. The cylinder of claim 8 wherein each fin has a thickness that is greater than the average thickness at 10% of the fin height and a thickness that is less than the average thickness at 90% of the fin height.

11. The cylinder of claim 8 wherein the at least one pair of fins are recessed from a top of the cylinder.

12. The cylinder of claim 8 wherein each fin has a free end that has a shape that is more aerodynamic than a fin end that is square.

13. An air-cooled engine, comprising:

at least two cylinders and a head associated with each cylinder, each cylinder having a longitudinal axis, the head having a rocker arm mounted to rotate about a rocker arm axis in the head, the head further including an intake port and an exhaust port, and the head mounted on a first cylinder of the two cylinders to define a combustion chamber, the head comprising at least two fins, each fin having a height-to-thickness ratio of greater than or equal to 5, each fin having a length that is at least 5 times the distance between the at least two fins at a location on the head that is between the first cylinder and the rocker arm axis on the head, and each fin positioned on the head with the fin length oriented along an axis that is substantially parallel to the longitudinal axis of the first cylinder.

14. The engine of claim 13 wherein more total fin surface area is provided near the exhaust port than near the intake port in the head.

15. The engine of claim 13 wherein the head occupies more space on an the exhaust side of the cylinder longitudinal axis than on an intake side of the cylinder longitudinal axis to provide additional space for additional cooling fins that are positioned in an area adjacent the exhaust port.

16. The engine of claim 13, further comprising fins on the head that are positioned over at least a portion of the combustion chamber.

17. An airplane, comprising:

an air-cooled engine having at least two cylinders and a head associated with each cylinder, each cylinder having a longitudinal axis, the head having a rocker arm mounted to rotate about a rocker arm axis in the head, the head further including an intake port and an exhaust port, and the head mounted on a first cylinder of the two cylinders to define a combustion chamber, the head comprising at least two fins, each fin having a height-to-thickness ratio of greater than or equal to 5, each fin having a length that is at least 5 times the distance between the at least two fins at a location on the head that is between the first cylinder and the rocker arm axis on the head, and each fin positioned on the head with the fin length oriented along an axis that is substantially parallel to the longitudinal axis of the first cylinder.

18. The airplane of claim 17 wherein more total fin surface area is provided near the exhaust port than near the intake port in the head.

19. The airplane of claim 17 wherein the head occupies more space on an exhaust side of the cylinder longitudinal axis than on an intake side of the cylinder longitudinal axis to provide additional space for additional cooling fins that are positioned in an area adjacent the exhaust port.

20. The airplane of claim 17 further comprising fins on the head that are positioned over at least a portion of the combustion chamber.

* * * * *